US007625042B2

(12) United States Patent
Friedrich

(10) Patent No.: US 7,625,042 B2
(45) Date of Patent: Dec. 1, 2009

(54) REMOTE QUICK RELEASE LOCKING MECHANISM

(75) Inventor: Norman Friedrich, Union, NJ (US)

(73) Assignee: Top Line Seating Inc., Kenilworth, NJ (US)

( * ) Notice: Subject to any disclaimer, the term of this patent is extended or adjusted under 35 U.S.C. 154(b) by 0 days.

(21) Appl. No.: 11/938,495

(22) Filed: Nov. 12, 2007

(65) Prior Publication Data

US 2008/0136228 A1 Jun. 12, 2008

Related U.S. Application Data

(60) Provisional application No. 60/865,307, filed on Nov. 10, 2006.

(51) Int. Cl.
*A47C 31/00* (2006.01)

(52) U.S. Cl. ..... 297/217.3; 297/344.13; 297/172; 297/463.1; 297/217.1

(58) Field of Classification Search ..... 297/344.13, 297/217.3, 344.2, 344.1, 344.19, 344.21, 297/463.1, 217.1; 248/500
See application file for complete search history.

(56) References Cited

U.S. PATENT DOCUMENTS

| | | | | |
|---|---|---|---|---|
| 5,102,192 | A * | 4/1992 | Barile, Sr. | 297/257 |
| 5,522,641 | A | 6/1996 | Infanti | |
| 5,678,886 | A * | 10/1997 | Infanti | 297/217.3 |
| 5,762,617 | A * | 6/1998 | Infanti | 601/49 |
| 5,791,731 | A | 8/1998 | Infanti | |
| 6,354,660 | B1 | 3/2002 | Friedrich | |
| 6,502,800 | B1 | 1/2003 | Ursini et al. | |
| 6,572,187 | B2 * | 6/2003 | Laufer | 297/217.1 |
| 7,367,624 | B2 * | 5/2008 | Garland | 297/362.11 |
| 7,407,228 | B1 * | 8/2008 | Infanti | 297/217.7 |
| 2003/0209931 | A1 * | 11/2003 | Glaser | 297/344.12 |
| 2007/0182227 | A1 * | 8/2007 | Ebel | 297/354.11 |

* cited by examiner

*Primary Examiner*—Laurie K Cranmer
(74) *Attorney, Agent, or Firm*—Timothy X. Gibson, Esq.; Gibson & Dernier LLP

(57) ABSTRACT

The invention relates to a remote mechanism and systems including a remote mechanism for securing a chair to a game machine and for effecting release of the chair from the game machine. The present mechanisms and systems are adapted to be used in conjunction with conventional and novel quick release bracket apparatus and provide remote locking and unlocking mechanisms therefor.

8 Claims, 7 Drawing Sheets

REMOTE QUICK RELEASE LOCKING MECHANISM

CROSS-REFERENCE TO RELATED APPLICATIONS

This application claims the benefit of U.S. Provisional Patent Application No. 60/865,307, filed Nov. 10, 2006, the entirety of which is incorporated herein by reference.

FIELD OF THE INVENTION

The subject invention relates to a remote mechanism and remote mechanism systems for securing a chair to a game machine and for effecting release of the chair from the game machine.

BACKGROUND OF THE INVENTION

Game machines, such as slot machines, typically define an upright rectangular structure with a front face that can be accessed by the user of the machine. The front face typically includes a changeable display of indicia to indicate whether the user has won and the amount of any such winning. The front of the machine further includes a slot or other such opening which receives the user's payment for the game. An actuator, such as a pivotable arm, typically is accessible from the front of the machine to enable the user to activate the machine after the required payment has been made. Furthermore, the front of the machine includes an opening from which any winnings will be dispensed. All of these operative parts of the game machine typically are disposed at a height that can be accessed easily by a user standing in front of the machine.

The prior art game machine also typically includes a securely locked cash box that can be accessed by the owners of the gaming establishment. The locked cash box will receive the payments from the users of the machine. Periodically the owners of the gaming establishment will open the receptacle to clean out the coins, chips or other payment that have been deposited by users of the machine.

Many users of game machines will play a particular machine for a considerable time. Thus, owners of gaming establishments often provide chairs for the users of the game machines. The seats of these chairs are at a sufficient elevation to enable the user of such a machine to be supported at a height with the arms and head at roughly the elevation as that of an individual standing in front of the game machine. Thus, a typical chair for a game machine is at a height more normally associated with a stool.

Many casinos or other gaming establishments have a large number of slot machines. Most casinos and other gaming establishments endeavor to create an orderly and attractive appearance. Thus, there is a desire to have the chairs for game machines and the chairs arranged in an orderly manner. This orderly arrangement can be achieved by fixing the base of the game machine chair in proximity to the front of the game machine. The secure mounting of the game machine also achieves several safety functions. For example, the affixation of the chair relative to the game machine ensures sufficiently wide aisles between rows of game machines, and hence ensures safe and easy ingress and egress from the casino. Additionally, the fixed mounting of the chairs to the game machines will prevent a tired or inebriated customer from toppling the chair while playing the game machine. Still further, there is a potential that an emotional game player could throw a chair. The affixation of the chair to the game machine prevents such an emotional outburst.

The fixed mounting of the game machine chair in front of the game machine unfortunately impedes the access to the cash box. Furthermore, the electrical and/or mechanical components of the game machine require periodic servicing. The permanently mounted game machine chair complicates such servicing. As a result, many game machine chairs are now provided with a quick release mechanism to facilitate disengagement of the chair from the machine and subsequent reconnection of the chair to the game machine.

One prior art structure for releasable engagement of a game machine chair to the machine is shown in U.S. Pat. No. 5,522,641. This patent shows a chair mounted to the top end of a vertical post. The lower end of the post is secured to the generally planar base that extends from the post toward the game machine. Most of the base is substantially planar. However, the portion of the base closest to the game machine defines an upwardly curled lip. The game machine is provided with a downwardly opening channel on the lower portion of the front surface of the game machine. The game machine chair and its base can be tilted toward the game machine and about the upwardly curled front lip of the base. This tilting enables the lip to be slid under the downwardly opening channel on the game machine. The chair and its base then can be pivoted back toward the floor with the upwardly curled lip securely engaged in the channel of the game machine. This prior art game machine chair prevents unintended movement of the chair and ensures an orderly row of chairs in front of the respective game machines. However, the tilting of the chair to access the cash box can be cumbersome and difficult.

Another prior art game machine chair is shown in U.S. Pat. No. 5,791,731. The game chair in this patent requires locking pins or swinging latches that must be manually removed to physically disengage the base of the game machine chair from the game machine. This game machine chair avoids the cumbersome lifting and tilting of the entire game chair and base to effect engagement and disengagement. However, the existing latch mechanisms create hazardous sharp areas near the feet of the game patron sitting in the chair. Furthermore, the existing latch mechanisms are aesthetically unattractive and are easily accessible by a patron who would like to move the chair. Even a small number of displaced chairs can create an aesthetically unattractive appearance for the entire casino and can block the aisles between rows of game machines.

U.S. Pat. No. 6,354,660 provides a quick release mechanism for a game machine chair that does not require tilting of the chair and its base, as well as a quick release game machine chair that requires a special tool or key to release the chair and its base. U.S. Pat. No. 6,354,660 provides a game machine chair with a base that is easily aligned with locking mechanisms on the game machine.

U.S. Pat. No. 6,502,800 discloses a quick release extrusion bracket with a lock for securing a chair, stool, seat, etc. with a base plate at the end of a supporting post, leg, etc. to a floor to facilitate release of the base plate from the bracket, thereby facilitating removal of the chair, stool, seat, etc. The lock enables the base plate to be locked to the bracket so that it may not be removed by a patron or other person without an appropriate tool or key.

In addition to game machines, establishments may desire to protect chairs, furniture and other devices from theft, vandalism, and other disorderly acts.

SUMMARY OF THE INVENTION

The remote mechanism and remote mechanism systems of the present invention are adapted to allow establishments to securely fasten such objects for safekeeping and are adapted to be oriented in any suitable manner with respect to the objects to improve accessibility for an operator, technician, or the like for repairs, upgrades, or the like.

The present invention is an improvement to the bracket apparatus of the prior art and provides a remote locking and unlocking mechanism therefor. The present invention is preferably adapted to be used in conjunction with the brackets disclosed in U.S. Pat. No. 6,354,660 and U.S. Pat. No. 6,502,800, both of which are incorporated by reference herein in their entirety.

In accordance with at least one aspect of the present invention, a remote mechanism is disclosed for actuating a locking device of a game machine chair assembly.

In accordance with another aspect of the present invention, a system is disclosed for securing a chair assembly to a game machine and for effecting release of the chair assembly from the game machine, including a remote mechanism for actuating a locking device; and a bracket having a locking device, wherein the bracket is adapted to receive and/or secure the chair assembly.

In accordance with yet another aspect of the present invention, a remote mechanism system is disclosed for securing a chair assembly to a game machine and for effecting release of the chair assembly from the game machine, including a remote mechanism for actuating a locking device; a bracket having a locking device, wherein the bracket is adapted to receive the chair assembly and wherein the bracket is disposed on and/or adjacent to the game machine; and a game machine chair assembly base plate.

Other aspects, features, advantages, etc. will become apparent to one skilled in the art when the description of the invention herein is taken in conjunction with the accompanying drawings.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown, but rather only by the issued claims. The drawings may not be to scale, and the aspects of the drawings may not be to scale relative to each other. To assist those of ordinary skill in the relevant art in making and using the subject matter hereof, reference is made to the appended drawings and figures, wherein:

A variant of the mechanism according to the invention is intended to be explained in more detail with reference to the subsequent FIGS., without wishing to restrict the latter to the embodiments shown here.

FIG. 1 is a partial perspective view of a game chair assembly showing an embodiment of a remote bracket device in accordance with at least one aspect of the present invention.

FIG. 2 is a cross-sectional view of a remote bracket device a portion of which is taken along line A—A of FIG. 1 in accordance with at least one aspect of the present invention.

FIG. 3 is a partial perspective view of a receptacle and pin of an embodiment of a remote mechanism in accordance with at least one aspect of the present invention.

FIG. 4 is a side view of an embodiment of a receptacle of a remote mechanism for a game chair assembly in accordance with at least one aspect of the present invention.

FIG. 5 is a rear view of an embodiment of a remote bracket mechanism in accordance with at least one aspect of the present invention.

FIG. 6 is a side view of a receptacle and motor of an embodiment of a remote mechanism in accordance with at least one aspect of the present invention.

FIG. 7 is a side view of a receptacle and motor with a wireless receiver of an embodiment of a remote mechanism in accordance with at least one aspect of the present invention.

FIG. 7A is a front view of a remote control for the wireless receiver as shown in FIG. 7 of an embodiment of a remote mechanism in accordance with at least one aspect of the present invention.

DETAILED DESCRIPTION OF THE EMBODIMENTS OF THE INVENTION

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in one embodiment" in various places in the specification are not necessarily all referring to the same embodiment.

Figure 1:
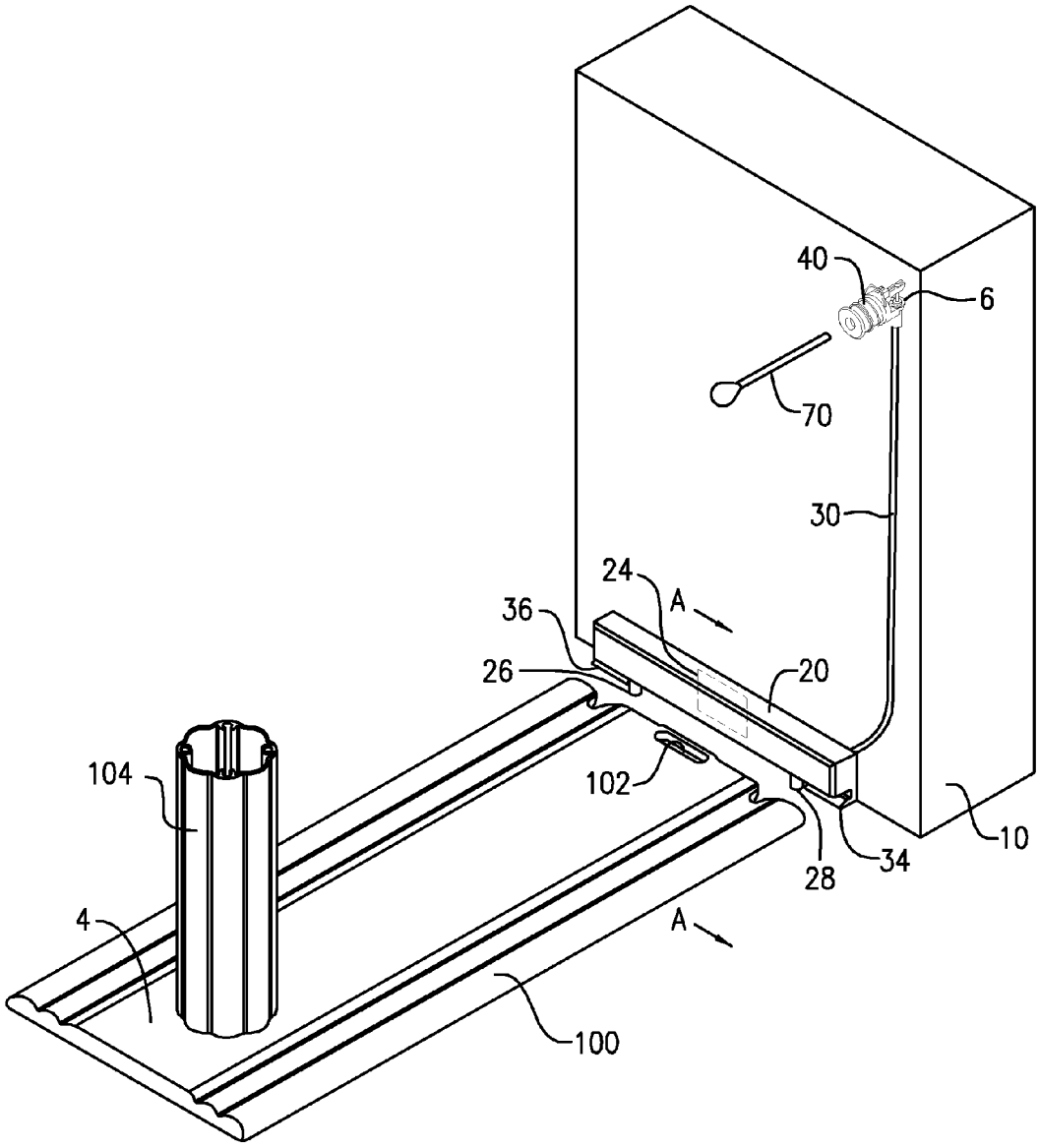
FIGS. 1-7A are views in accordance with embodiments of the present invention.

Now referring to FIG. 1, in general, a remote mechanism 6 for locking and/or unlocking a locking device is disclosed for releasing a game machine chair assembly 4 from a game machine 10. The remote mechanism 6 is compatible with game machines and game machine chair assemblies, which may include a bracket 20. As such, the remote mechanism 6 can be used in conjunction with existing chairs and/or game machines, i.e., installed aftermarket, if desired.

Now referring to FIGS. 1-7A various details of embodiments in accordance with the present invention are shown. In accordance with at least one embodiment, now referring to FIG. 1, a game machine chair assembly 4 includes at least a base plate 100 including a game chair column 104. In accordance with at least one embodiment, base plate 100 includes an aperture 102 for receiving a latching device 24. A game machine chair assembly 4 is typically disposed in front of a game machine 10 or the like.

Figure 2:
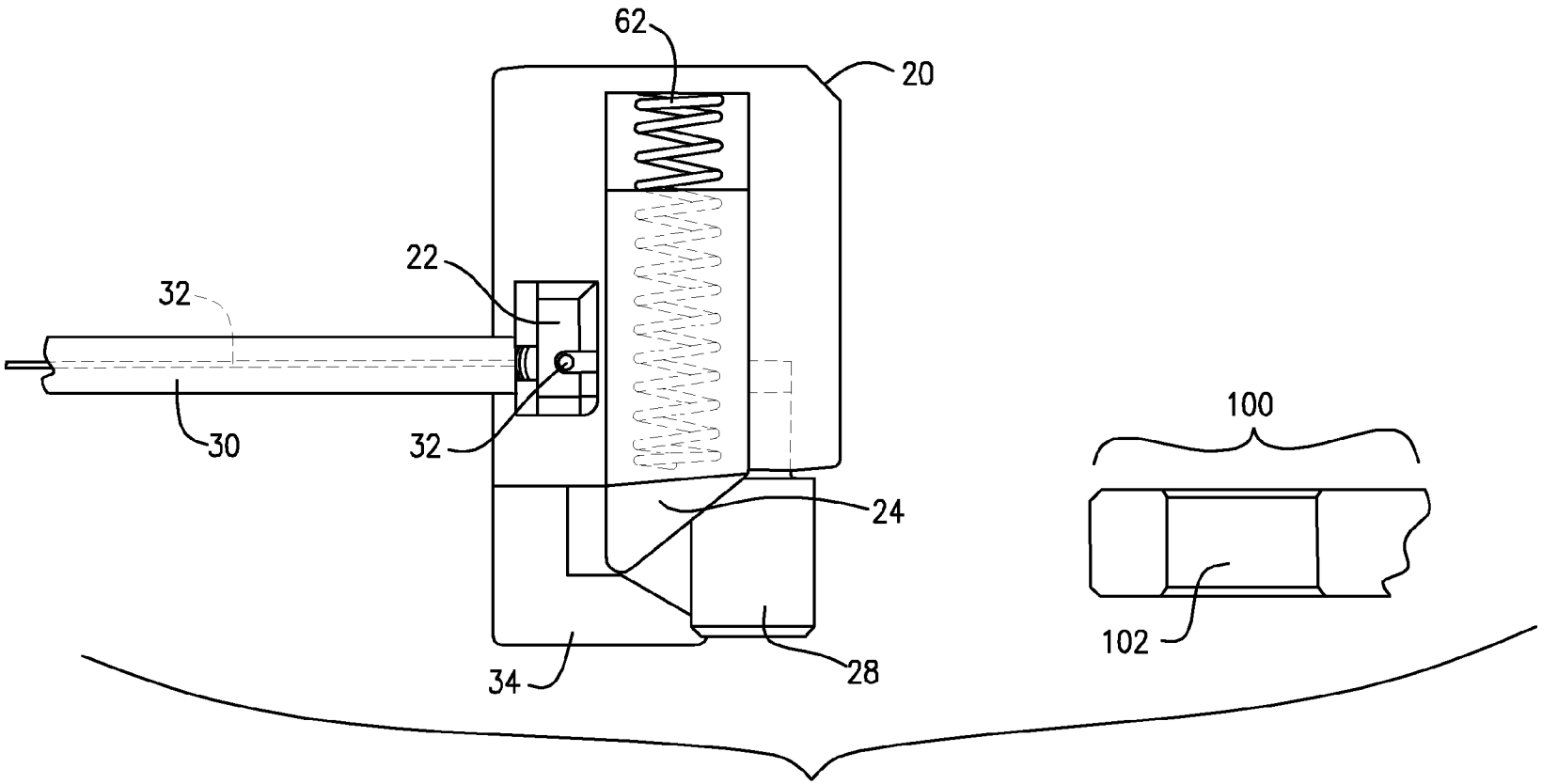

In accordance with at least one embodiment, now referring to FIGS. 1-2, a bracket 20 is adapted to receive and/or secure the chair assembly 4. Bracket 20 includes a latch device 24 for engaging an aperture 102 formed in a base plate 100 of a chair assembly 4. Now further referring to FIG. 5, bracket 20 includes a latch device 24, a lifting member 22, a screw 59 disposed on the latch 24, a biasing member 62, and a channel 63. Bracket 20 may include one or more means for securing the bracket to a game machine floor or wall, such as, but not limited to, an opening 65 formed in the bracket in a suitable position for receiving an anchoring device, such as, but not limited to, a bolt, screw, or the like. Those skilled in the art will recognize bracket 20 may be secured to a supporting structure using adhesives, magnets, or the like. In accordance with at least one embodiment, now referring to FIGS. 1, 2, and 5, a bracket 20 may include one or more guidance devices, such as, but not limited to, a post 26, 28; a lift 34, 36; or the like. In some embodiments, one or more guidance lifts 34, 36 direct a base plate 100 upon insertion into the bracket 20 to a position in which a latch device 24 is able to engage an aperture 102 of the base plate 100. In some embodiments, one or more guidance posts 26, 28 assist in securing the base plate 100 to the bracket 20 by reducing and/or preventing the vertical and/or lateral shifting of a base plate 100 while the base plate 100 is locked into a bracket 20. In accordance with at least one embodiment, now referring to FIG. 1, bracket 20 is disposed on and/or adjacent to a game machine 10 or another suitable location.

Figure 5:
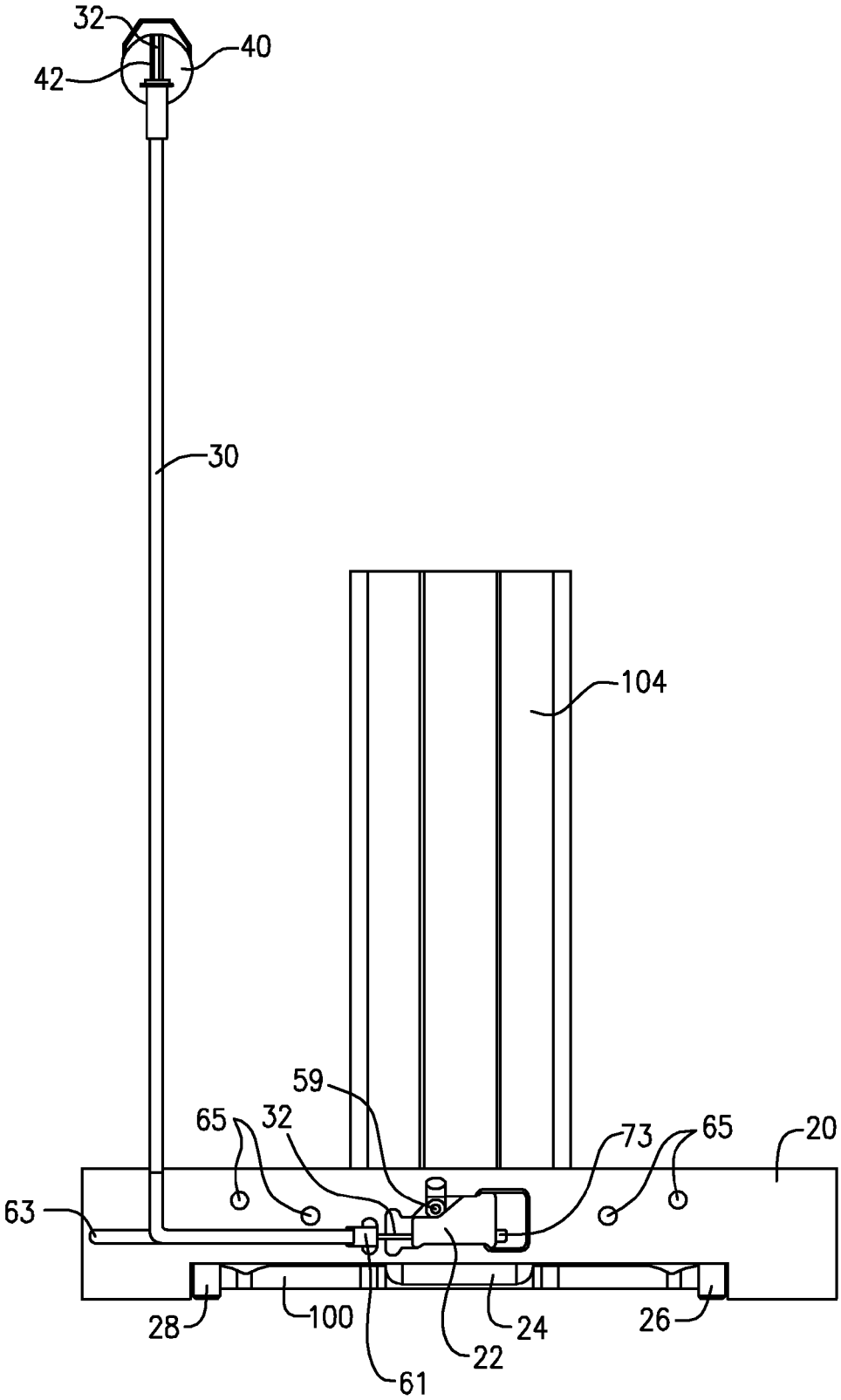

Now referring to FIGS. 2 and 5, lifting member 22 is adapted to lift and/or lower latch device 24 and adapted to engage a cable 32 optionally enclosed within a conduit 30 to communicate with a remote mechanism 6. A cable 32 engages at one end a lifting member 22, the lifting member 22 in contact with latch device 24. Cable 32 is adapted to pull and/or release lifting member 22 to the left or right, and the latch 24 is thereby lifted or lowered, respectively. Now referring to FIG. 2, a bracket 20 includes a latch device 24 including one or more biasing member, such as, but not limited to, a spring 62 adapted to force the latch 24 downward to introduce and/or improve a secure connection between latch 24 and an aperture 102 of a base plate 100 of a chair assembly 4. Bracket 20 includes a channel 63 in which a portion of conduit 30 including a portion of a cable 32 communicating with bracket 20 is disposed. Now referring to FIG. 3, a cable 32 runs through a conduit 30 up from bracket 20 as shown in FIGS. 1, 2, and 5 and engages a lifting member 42 disposed on receptacle 40 of a remote mechanism 6 described in detail hereinbelow. While the foregoing embodiments show a bracket substantially in accordance with that described in U.S. Pat. No. 6,354,660, it will be apparent to those skilled in the art that the present invention is adaptable to be employed with the bracket described in U.S. Pat. No. 6,502,800 or other quick release brackets.

Figure 3:
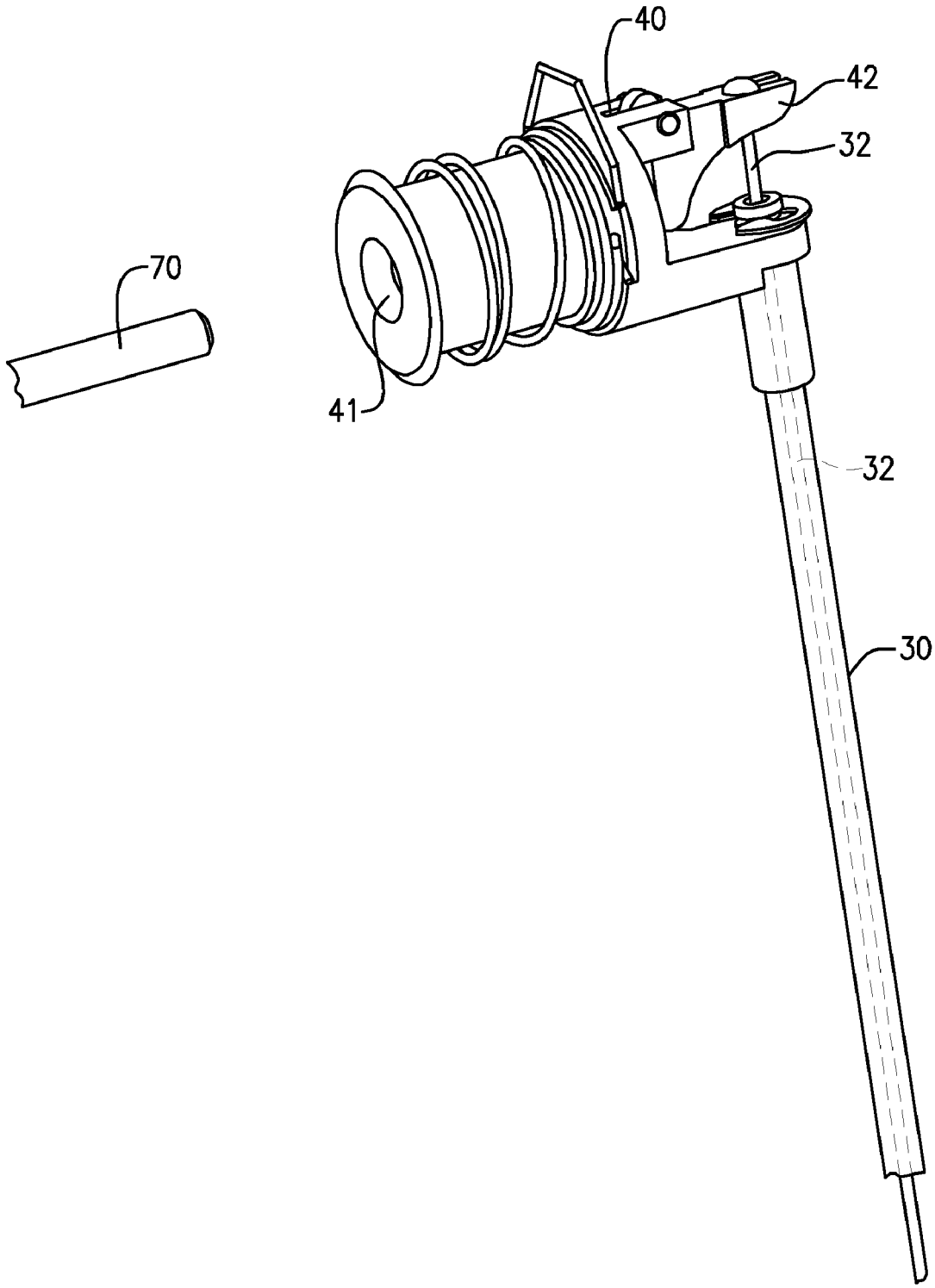
Figure 4:
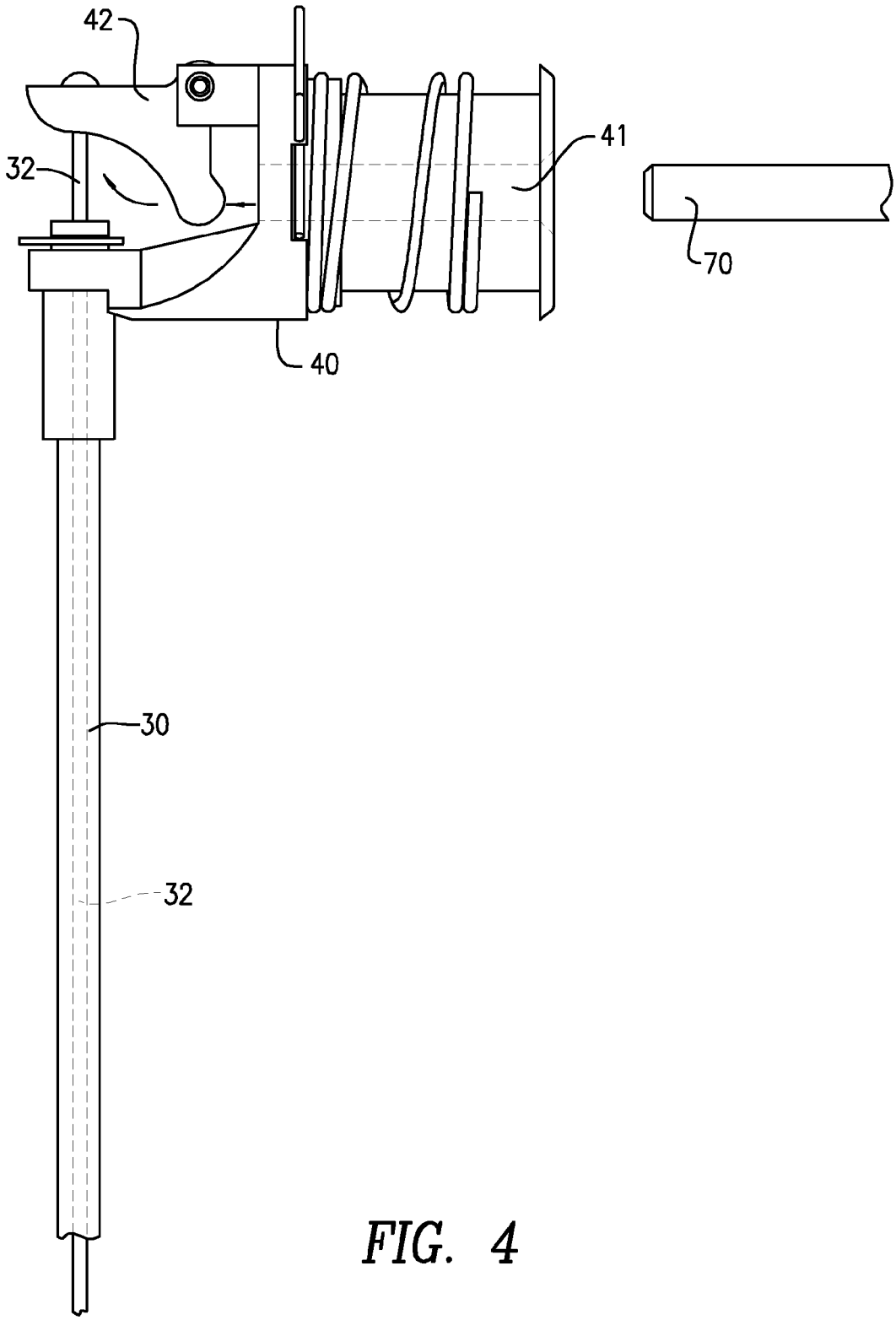

Now referring to FIGS. 3-5, a remote mechanism 6 includes a receptacle 40, a lifting member 42 operably disposed with the receptacle 40, a conduit 30, and a cable 32 disposed within the conduit 30 and operably connected to the lifting member 42. In some embodiments, a remote mechanism 6 may include a cable 32 extending therefrom including a cable end cap 73, which introduces and/or improves pulling leverage when operably connected to a lifting member 22. Now referring specifically to FIGS. 3 and 4, a remote mechanism 6 also may include a bore 41 formed in receptacle 40, wherein the bore 41 is adapted to receive a locking and/or unlocking tool, such as, but not limited to, a key or pin 70. In operation, when a pin 70 is inserted into a bore 41 of a receptacle 40, an end of pin 70 contacts a lifting member 42 and rotates the lifting member 42 upwards in the direction shown by the arrows in FIG. 4, thereby lifting a cable 32 upwards as shown in FIGS. 3 and 4. When a remote mechanism 6 is operably connected with a bracket 20 via cable 32, the lifting of a cable 32 results in the pulling of the cable 32 on a lifting member 22 of bracket 20, which in turn lifts a latch 24, allowing an aperture 102 of base plate 100 to be disengaged from a bracket 20. In an embodiment, when the pin 70 is removed from receptacle 40 of a remote mechanism 6, lifting member 42 is lowered, cable 32 is lowered and lifting member 22 lowers latch 24.

Figure 6:
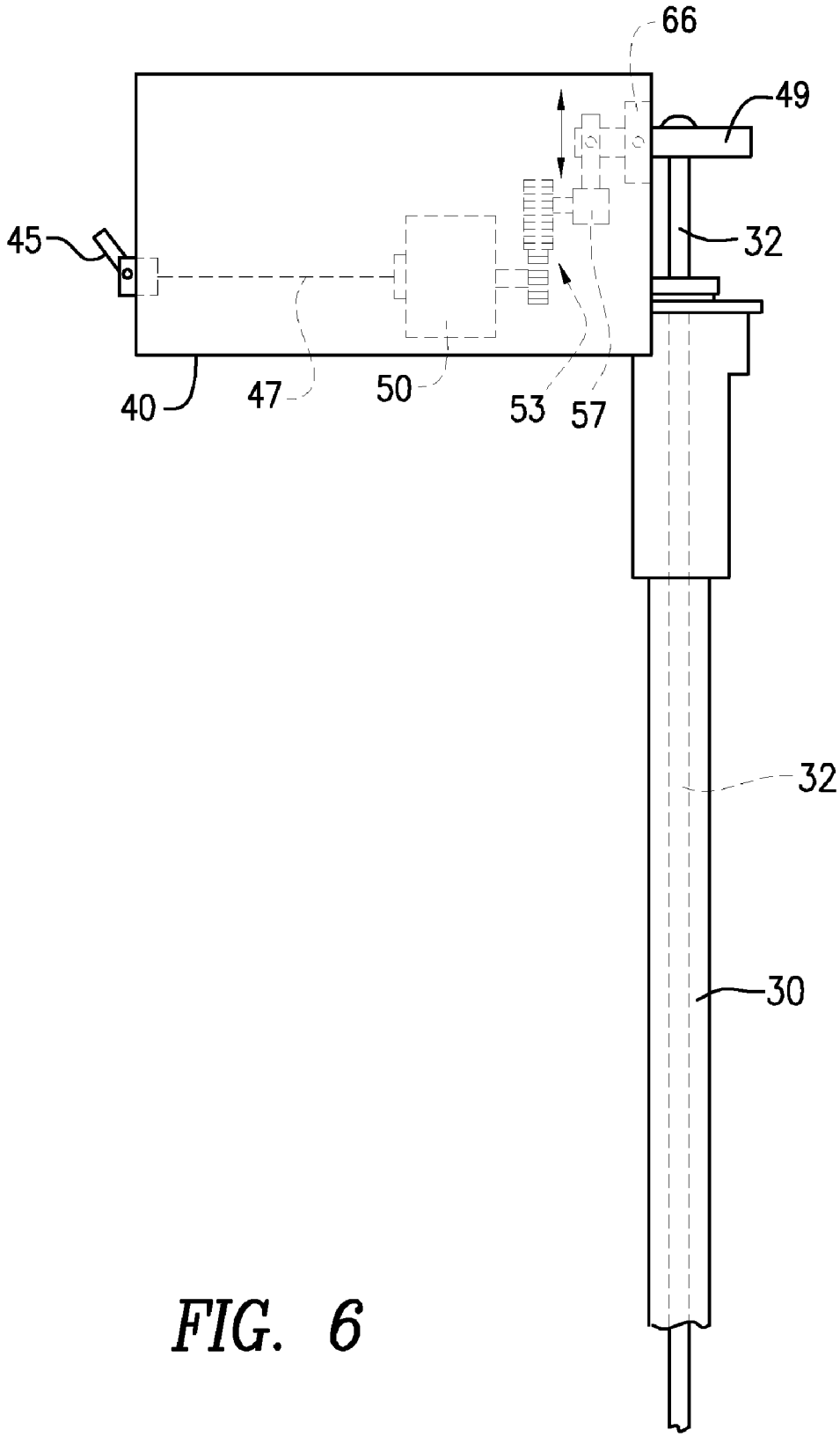

Now referring to FIG. 6, in an alternative embodiment, a remote mechanism 6 includes a lifting member 49, a conduit 30, a cable 32, a motor 50, a wire 47, a gear assembly 53, a crank shaft 57, a switch 45 and a fulcrum 66. In some embodiments, a switch 45 of a receptacle 40 (which in this and other embodiments may be a housing) turns on and/or off a motor 50 through wire 47, wherein the motor 50 turns a gear assembly 53 and moves a crank shaft 57 up and down as indicated by the arrow in FIG. 6 to rotate a lifting member 49 around a fulcrum 66 thereby lifting a cable 32 upwards from within a conduit 30. In a variation of the embodiment in FIG. 6, now referring to FIGS. 7 and 7A, a remote mechanism 6 may include a wireless receiver and/or sensor 83 adapted to communicate with a switch 87 on a remote control 85 to turn on and/or off a motor 50.

In a preferred embodiment, now referring to FIG. 1, a receptacle 40 is mounted to a game machine 10. There may be configurations in which it is advantageous to have the receptacle 40 mounted near the floor, on top of the game machine 10, or any suitable location. In yet further embodiments, a receptacle 40 may be mounted vertically or horizontally in any place convenient for a technician. Receptacle 40 may be located, for example, near or on the floor; on the game machine; on the bracket; on a different floor of a building; on a wall; on a ceiling; or in another room. As will be apparent to those having skill in the art, the conduit 30 can be oriented in any suitable manner with respect to a bracket 20 to improve accessibility by an operator to receptacle 40 of a remote mechanism 6.

In many embodiments, a conduit 30 may be mounted on the front face of a game machine 10 upward from a bracket 20 and downward from a receptacle 40 of a remote mechanism 6, as shown in FIG. 1 so that no bending over is required from the technician or other user to release the base plate 100 from the bracket 20.

Figures 7, 7A:
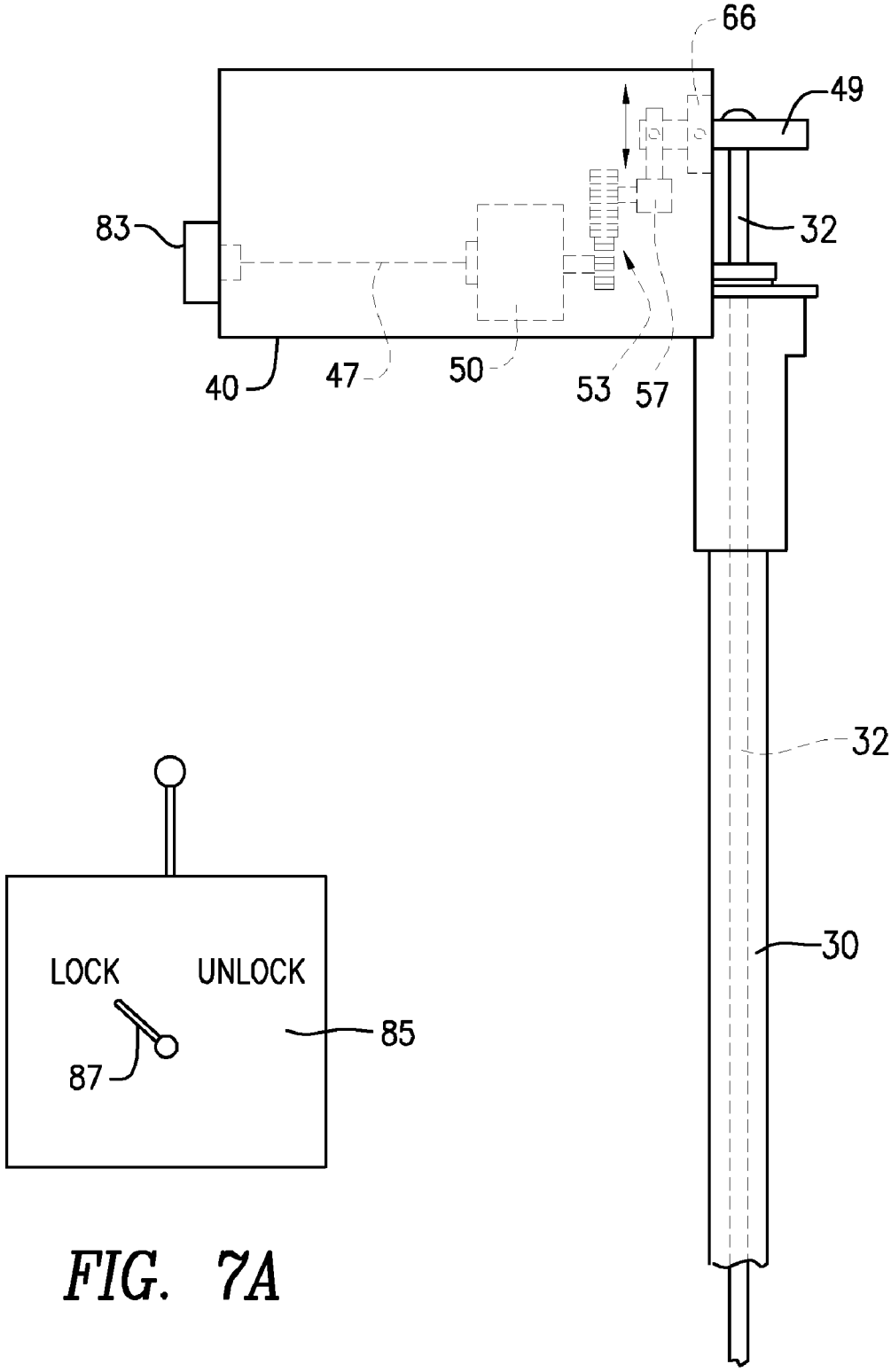

In accordance with at least one embodiment, a remote mechanism 6 may be activated with a tool, such as, but not limited to, a key or pin 70 as in FIGS. 1, 3, and 4; a switch 45 as shown in FIG. 6; a remote control 85 as shown in FIG. 7A used in combination with a wireless receiver 83 as shown in FIG. 7; or the like, adapted to actuate a cable 32 of a remote mechanism 6 and to lock and/or unlock a latch device 24 of a bracket 20.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A remote mechanism for actuating a locking device operable to releasably engage a chair assembly to a game machine, the remote mechanism comprising a tool-receiving receptacle having a bore formed therein, and a lifting member positioned to receive contact by a tool introduced in the bore of the receptacle, wherein the lifting member is operably connected to a cable and is operable to move the cable, and wherein the cable is operably connected to the locking device.

2. The remote mechanism of claim 1, further comprising a conduit operable to enclose the cable therein.

3. The remote mechanism of claim 1, wherein the locking device comprises a bracket operable to receive a chair assembly, and the locking device comprises a latch operable to releasably engage the chair assembly.

4. The remote mechanism of claim 3, wherein the lifting member is operable to exert a pulling force on the cable which in turn is operable to lift and/or lower the latch for locking and unlocking the chair assembly to the locking device.

5. The remote mechanism of claim 1, wherein the lifting member is positioned to interact with a tool introduced in the receptacle.

6. A system for releasably securing a chair assembly to a game machine, comprising:

a remote mechanism comprising a tool-receiving receptacle, wherein the remote mechanism is operable to actuate a locking device; wherein the locking device is operable to releasably secure a chair assembly adjacent to a game machine, and the remote mechanism is operably connected via a cable extending from the remote mechanism to the locking; and a bracket operable to receive a base plate of the chair assembly, the bracket having a channel for receiving the cable of the remote mechanism and a latch operable to releasably engage the chair assembly, the latch comprising at least one biasing member operable to exert a force on the latch in a direction for locking the latch, wherein the latch is operably connected to a first lifting member via the cable.

7. The system of claim 6, wherein the bracket further comprises at least one guidance device operable to position the base plate such that the latch is able to releasably engage the base plate.

8. A system for releasably securing a chair assembly to a game machine, comprising:

a remote mechanism for actuating a locking device;

the locking device operable to releasably secure a chair assembly adjacent to a game machine, wherein the remote mechanism is operably connected to the locking device; and a bracket comprising a channel for receiving the cable of the remote mechanism, and the bracket comprising a latch operable to receive a chair assembly, wherein the latch is operably connected to a first lifting member, the first lifting member is operable to receive an end of a cable, an other end of the cable is operable to receive a second lifting member of the remote mechanism, and the second lifting member is operable to move the cable.

* * * * *